US008000642B2

(12) United States Patent
Nakamura et al.

(10) Patent No.: US 8,000,642 B2
(45) Date of Patent: Aug. 16, 2011

(54) FIXING DEVICE AND IMAGE FORMING APPARATUS INCLUDING THE FIXING DEVICE USING A DIELECTRIC MATERIAL HEATED BY AN ELECTRIC FIELD

(75) Inventors: Takuma Nakamura, Yokohama (JP); Yukimichi Someya, Machida (JP); Misaki Shimizu, Komae (JP)

(73) Assignee: Ricoh Company Limited, Tokyo (JP)

( * ) Notice: Subject to any disclaimer, the term of this patent is extended or adjusted under 35 U.S.C. 154(b) by 440 days.

(21) Appl. No.: 12/123,040

(22) Filed: May 19, 2008

(65) Prior Publication Data

US 2008/0292373 A1 Nov. 27, 2008

(30) Foreign Application Priority Data

May 23, 2007 (JP) ..... 2007-136107

(51) Int. Cl.
*G03G 15/20* (2006.01)

(52) U.S. Cl. ..... 399/328; 399/336

(58) Field of Classification Search ..... 399/336, 399/328, 329, 330; 219/216, 243, 469; 118/60
See application file for complete search history.

(56) References Cited

U.S. PATENT DOCUMENTS

| | | | | |
|---|---|---|---|---|
| 5,115,279 | A * | 5/1992 | Nishikawa et al. | 399/331 |
| 5,410,394 | A * | 4/1995 | Wayman et al. | 399/329 |
| 6,617,090 | B2 * | 9/2003 | Pickering et al. | 430/124.34 |
| 2002/0009315 | A1 * | 1/2002 | Tomita | 399/323 |
| 2002/0061211 | A1 * | 5/2002 | Kamijo et al. | 399/328 |
| 2007/0201915 | A1 * | 8/2007 | Maeda et al. | 399/333 |
| 2007/0230984 | A1 * | 10/2007 | Noguchi | 399/69 |

FOREIGN PATENT DOCUMENTS

| | | | |
|---|---|---|---|
| JP | 49-38171 | | 10/1974 |
| JP | 1-36107 | | 7/1989 |
| JP | 03293691 | A * | 12/1991 |
| JP | 2005-301018 | | 10/2005 |
| JP | 2006-23608 | | 1/2006 |
| JP | 2006258831 | A * | 9/2006 |
| JP | 2007-17723 | | 1/2007 |

OTHER PUBLICATIONS

Machine English Translation of JP2006-258831.*

U.S. Appl. No. 12/186,906, filed Aug. 6, 2008, Someya, et al.

* cited by examiner

*Primary Examiner* — David M Gray

*Assistant Examiner* — Billy J Lactaoen

(74) *Attorney, Agent, or Firm* — Oblon, Spivak, McClelland, Maier & Neustadt, L.L.P.

(57) ABSTRACT

A fixing device and an image forming apparatus including the fixing device. The fixing device includes a fixing member having a dielectric body to fix a toner image onto a recording medium by heating and melting the toner image onto the recording medium, a dielectric heating portion to heat the fixing member by dielectric heating, and a pressure member to press against the fixing member to form a nip portion therebetween to nip the recording medium as the recording medium is conveyed therebetween.

6 Claims, 5 Drawing Sheets

FIXING DEVICE AND IMAGE FORMING APPARATUS INCLUDING THE FIXING DEVICE USING A DIELECTRIC MATERIAL HEATED BY AN ELECTRIC FIELD

CROSS-REFERENCE TO RELATED APPLICATION

This patent specification is based on and claims priority from Japanese Patent Application No. 2007-136107, filed on May 23, 2007 in the Japan Patent Office, the entire contents of which are hereby incorporated by reference herein.

BACKGROUND

1. Field of the Invention

The present invention relates to a fixing device and an image forming apparatus including the fixing device.

2. Description of the Related Art

In an image forming apparatus such as a copier or a printer, a fixing device taking a dielectric heating is known for reducing a start-up time of the fixing device.

Such a dielectric heating fixing device includes a conveyance belt that conveys a recording medium with an unfixed toner image thereon and a plurality of pairs of rod electrodes located facing the recording medium conveyed by the conveyance belt. By applying a high-frequency electricity to the rod electrodes, heat is generated in the unfixed toner on the recording medium by dielectric loss, i.e., the toner image is heated by dielectric heating. The melted toner penetrates the fibers of the recording medium and is thereby fixed onto the recording medium.

The dielectric heating fixing device may be used with an additional fixing device that uses a heater. The additional fixing device is located on the downstream side relative to the dielectric heating fixing device in a direction of movement of the recording medium and includes a fixing roller with the heater therein and a pressure roller that presses against the fixing roller to form a nip portion therebetween. In this system, after the toner image is primarily fixed onto the recording medium by dielectric heating as described above, the recording medium is conveyed to the nip portion in the additional fixing device. The toner image is securely fixed onto the recording medium by application of heat and pressure in the nip portion.

There is another type of fixing device that uses electromagnetic induction heating instead of the dielectric heating to reduce the start-up time of the fixing device. Such a fixing device generates an alternating magnetic field around a heat generation member, thereby generating heat in the heat generation member by eddy current or hysteresis loss. A fixing member can be configured as the heat generation member to be heated by electromagnetic induction.

With regard to the above-described dielectric heating fixing device, as noted above the toner melted by dielectric heating penetrates the fibers of the recording medium, thereby fixing the toner image onto the recording medium. However, such fixation may be insufficient, particularly in forming a color image, since a gap generated between color toners in the fixed image may result in insufficient gloss.

By contrast, sufficient fixation can be ensured by using an additional fixing device with a heater as described above, since an image is primarily fixed by dielectric heating and secondarily fixed by application of heat and pressure in the nip portion formed between the rollers. However, this arrangement, which requires the additional fixing device with a heater in addition to a dielectric heating fixing device, may increase the device size, cost, and power consumption. Further, the effect of reduction in the start-up time resulted from dielectric heating may not be satisfactory.

The fixing device using electromagnetic induction heating does not directly solve the problems described above, since the configuration and the heating mechanism thereof are different from those of the dielectric heating fixing device.

SUMMARY OF THE INVENTION

Described herein is a novel charging device that includes a fixing member having a dielectric body to fix a toner image onto a recording medium by heating and melting the toner image onto the recording medium, a dielectric heating portion to heat the fixing member by dielectric heating, and a pressure member to press against the fixing member to form a nip portion therebetween to nip the recording medium as the recording medium is conveyed therebetween.

Further described herein is a novel image forming apparatus that includes the fixing device as described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
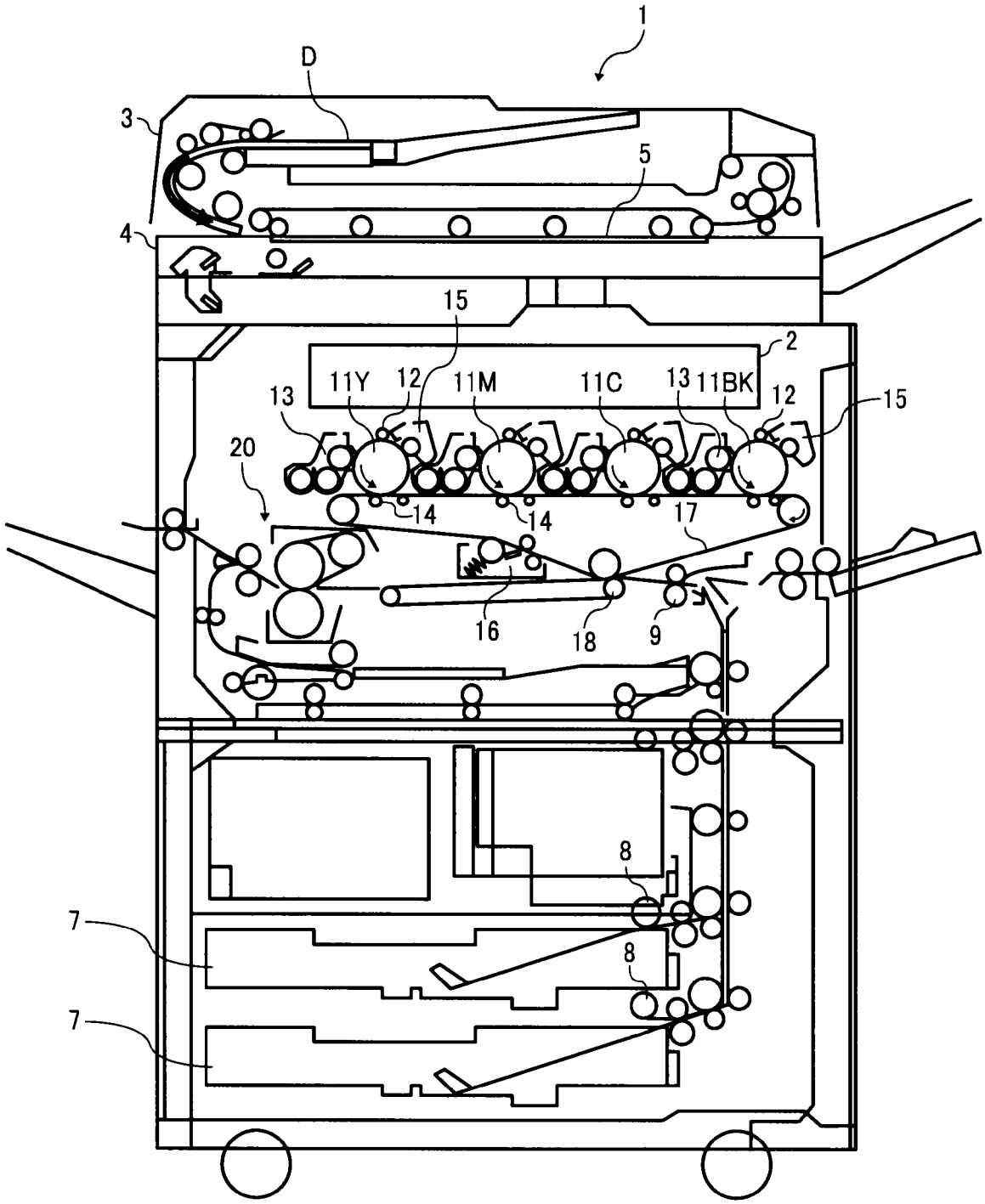
FIG. 1 is a diagram illustrating an overall configuration of an image forming apparatus according to a first embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 2:
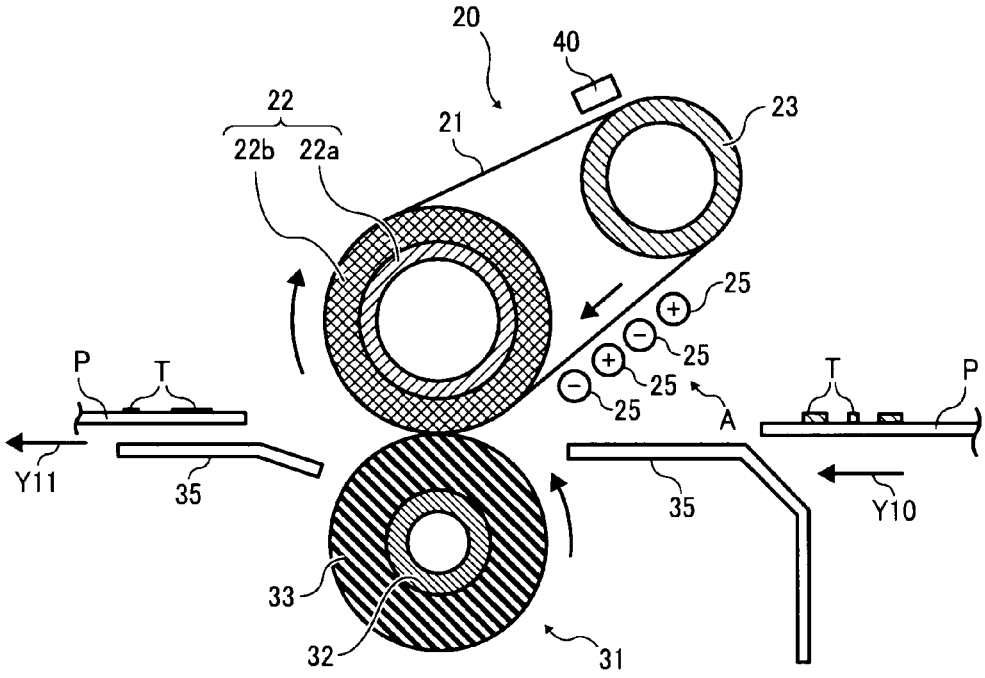
FIG. 2 is a schematic cross-sectional diagram illustrating a fixing device included in the image forming apparatus of FIG. 1.

Referring now to the drawings, wherein like reference numerals designate identical or corresponding parts throughout the several views thereof, particularly to FIG. 2, fixing devices according to exemplary embodiments of the present invention are described. It should be noted that descriptions of identical or corresponding parts in the drawings are hereinafter simplified or omitted as necessary.

Referring to FIGS. 1 through 4, a first embodiment of the present invention is described.

In order to facilitate an understanding and appreciation of the novel features and advantages of the present invention, the overall configuration and operation of an image forming apparatus according to the first embodiment are now described, again with reference to FIG. 1.

In FIG. 1, an image forming apparatus 1, which in this embodiment is a tandem color copier, includes a writing unit 2 that emits a laser beam based on input image information, an original feed unit 3 that feeds an original D to an original read unit 4, the original read unit 4 that reads image information of the original D, a paper feed unit 7 that stores a recording medium P such as transfer paper, a registration roller 9 that controls timing of conveying the recording medium P, photosensitive drums 11Y, 11M, 11C, and 11BK on which toner images of four colors (yellow, magenta, cyan, and black) are formed, a charging unit 12 that charges the surface of each of the photosensitive drums 11Y, 11M, 11C, and 11BK, a development unit 13 that develops a latent electrostatic image formed on each of the photosensitive drums 11Y, 11M, 11C, and 11BK, a transfer bias roller (primary transfer bias roller) 14 that transfers the toner image formed on each of the photosensitive drums 11Y, 11M, 11C, and 11BK to an intermediate transfer belt 17 in such a way that the toner images are superimposed one atop another, and a cleaning unit 15 that collects toner remaining on each of the photosensitive drums 11Y, 11M, 11C, and 11BK after transfer.

The image forming apparatus 1 also includes an intermediate transfer belt cleaning unit 16 that cleans the intermediate transfer belt 17, the intermediate transfer belt 17 to which the toner images of the plurality of colors are superimposed and transferred one atop another, a secondary transfer bias roller 18 that transfers a color toner image formed on the intermediate transfer belt 17 to the recording medium P, and a fixing device 20 that fixes the toner image (unfixed image) onto the recording medium P.

A typical color image formation process performed by the image forming apparatus is now described.

The original D placed on an original table is conveyed in the direction indicated by an arrow shown in FIG. 1 by conveyance rollers included in the original feed unit 3 and placed on a contact glass 5 included in the original read unit 4, where the image information of the original D is optically read.

Specifically, the original read unit 4 scans the image of the original D placed on the contact glass 5 by irradiating the original D with light emitted from an illumination lamp. The light reflected from the original D is then imaged by a color sensor using mirrors and lenses. The color image information of the original D is read separately for each RGB (red, green, and blue) color by the color sensor and converted into electrical signals hereinafter referred to as image signals. The RGB image signals are subjected to certain types of image processing, such as color conversion, color correction, and spatial frequency correction, at an image processing unit to obtain color image information of the colors yellow, magenta, cyan, and black.

The image information of yellow, magenta, cyan, and black is transmitted to the writing unit 2, which emits a laser beam (irradiation light) directed to the photosensitive drums 11Y, 11M, 11C, and 11BK based on the image information of the corresponding color.

The four photosensitive drums 11Y, 1M, 11C, and 11BK rotate counterclockwise as illustrated in FIG. 1. At a position facing the charging unit 12, the surface of each of the photosensitive drums 11Y, 11M, 11C, and 11BK is uniformly charged (a charging process), thereby generating a charged potential thereon. The charged surface of each of the photosensitive drums 11Y, 11M, 11C, and 11BK is then moved to a position where it is irradiated with a laser beam.

In the writing unit 2, four light sources emit separate laser beams corresponding to the respective image signals for each color. The laser beams pass through different light paths depending on the color components of yellow, magenta, cyan, and black (an irradiation process).

Specifically, after the charging process performed by the charging unit 12, the surface of the photosensitive drum 11Y located on the leftmost side in FIG. 1 is irradiated with the laser beam corresponding to the yellow component. The laser beam is scanned along the axis of rotation of the photosensitive drum 11Y (i.e., in a main scanning direction) by a rapidly rotating polygon mirror, thereby forming a latent electrostatic image corresponding to the yellow component on the photosensitive drum 11Y.

Similarly, the surface of the photosensitive drum 11M located second from left in FIG. 1 is irradiated with the laser beam corresponding to the magenta component, thereby forming a latent electrostatic image corresponding to the magenta component. The surface of the photosensitive drum 11C located on the second from right in FIG. 1 is irradiated with the laser beam corresponding to the cyan component, thereby forming a latent electrostatic image corresponding to the cyan component. Similarly, the surface of the photosensitive drum 11BK located on the right in FIG. 1 is irradiated with the laser beam corresponding to the black component, thereby forming a latent electrostatic image corresponding to the black component.

After the latent electrostatic images are formed, the surface of each of the photosensitive drums 11Y, 11M, 11C, and 11BK is then moved to a position facing the development unit 13 where toner of each color is supplied to each of the photosensitive drums 11Y, 11M, 11C, and 11BK to develop the latent electrostatic images thereon (a developing process).

After the developing process, the surface of each of the photosensitive drums 11Y, 11M, 11C, and 11BK is then moved to a position facing the intermediate transfer belt 17 where the transfer bias rollers 14 are located so as to contact the inner surface of the intermediate transfer belt 17. At the transfer bias rollers 14, the toner images formed on the photosensitive drums 11Y, 11M, 11C, and 11BK are sequentially superimposed and transferred to the intermediate transfer belt 17 one atop another, thereby forming a full color image thereon (a primary transfer process).

After the primary transfer process, the surface of each of the photosensitive drums 11Y, 11M, 11C, and 11BK is then moved to a position facing the cleaning unit 15, which collects toner remaining on each of the photosensitive drums 11Y, 11M, 11C, and 11BK (a cleaning process).

Subsequently, the surface of each of the photosensitive drums 11Y, 11M, 11C, and 11BK passes through a discharging unit, not shown, to complete the process of image formation on the photosensitive drums 11Y, 11M, 11C, and 11BK.

The intermediate transfer belt 17 with the color image thereon travels clockwise in FIG. 1 to a position facing the secondary transfer bias roller 18, where the color toner image is transferred to the recording medium P (a secondary transfer process).

After the secondary transfer process, the surface of the intermediate transfer belt 17 is moved to the intermediate transfer belt cleaning unit 16, which collects toner remaining on the intermediate transfer belt 17. The transfer process on the intermediate transfer belt 17 is thus completed.

The recording medium P is conveyed to a secondary transfer nip formed between the intermediate transfer belt 17 and the secondary transfer bias roller 18 from the paper feed unit 7 by the registration roller 9.

Specifically, the recording medium P is fed from the paper feed unit 7 by a paper feed roller 8, passes a conveyance guide, and is conveyed to the registration roller 9. The recording medium P is then conveyed to the secondary transfer nip by the registration roller 9 according to a particular timing.

The recording medium P to which the full color image has been transferred is conveyed to the fixing device 20 by a conveyance belt. In the fixing device 20, the color image (toner) is fixed onto the recording medium P at a nip portion formed between a fixing belt and a pressure roller (a fixing process).

After the fixing process, the recording medium P is output from the image forming apparatus 1 by a paper output roller to complete image formation.

Figure 3:
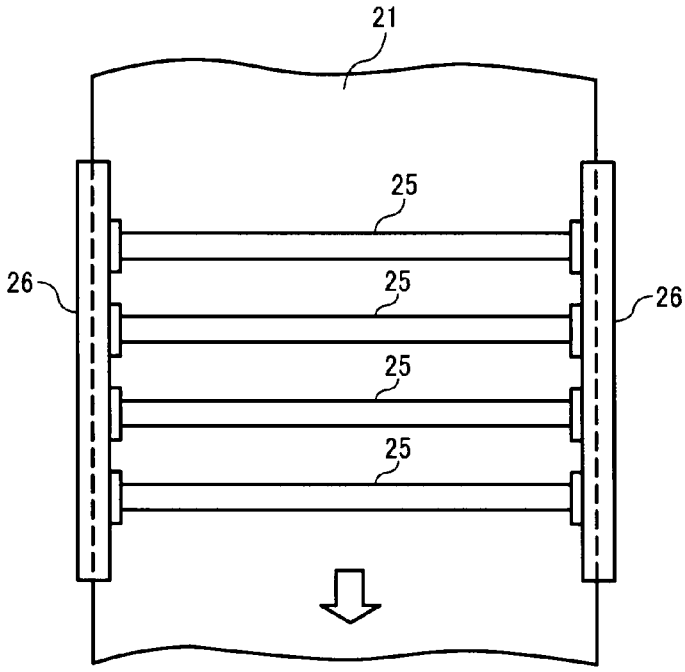
FIG. 3 is a front view of a dielectric heating portion included in the fixing device of FIG. 2.
Figure 4:
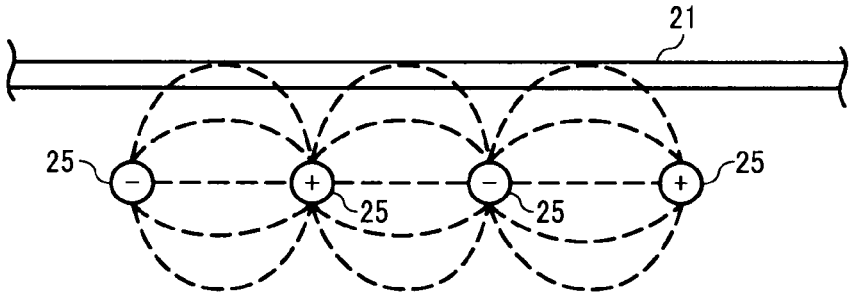
FIG. 4 is a schematic diagram illustrating electric lines of force generated around a fixing belt included in the fixing device of FIG. 2.

Referring now to FIGS. 2 through 4, the configuration and operation of the fixing device 20 included in the image forming apparatus 1 are described.

FIG. 2 is a schematic cross-sectional diagram illustrating the fixing device 20. FIG. 3 is a front view of a dielectric heating portion included in the fixing device 20 as viewed from the direction indicated by arrow A shown in FIG. 2. FIG. 4 is a schematic diagram illustrating electric lines of force generated around a fixing belt 21 included in the fixing device 20.

As illustrated in FIG. 2, the fixing device 20 includes the fixing belt 21 serving as a fixing member, an auxiliary fixing roller 22 (roller member), a support roller 23 (roller member), a pressure roller 31 serving as a pressure member, a dielectric heating portion (rod electrodes 25), a temperature sensor 40, and guide plates 35.

The fixing belt 21 serving as a fixing member is a multilayer endless belt that is formed by laminating an elastic layer and a releasing layer on a heat generation layer formed of a dielectric body.

The heat generation layer (dielectric body) of the fixing belt 21 is formed of a material with a high dielectric loss in a high-frequency band of 1 to 200 MHz. For example, in the first embodiment, the heat generation layer (dielectric body) of the fixing belt 21 is formed of polyamide. Such configuration dramatically improves the efficiency of heating of the fixing belt 21 by the dielectric heating portion.

The elastic layer of the fixing belt 21 is formed of an elastic material such as fluororubber, silicone rubber, or foamable silicone rubber.

The releasing layer of the fixing belt 21 is formed of a material such as PFA (polytetrafluoroethylene-perfluoroalkyl vinyl ether copolymer), polyimide, polyetherimide, or PES (polyether sulphone). By providing a releasing layer on the surface of the fixing belt 21, proper release of the toner (toner image T) is ensured.

The fixing belt 21 is stretched around and supported by the two roller members, i.e. the auxiliary fixing roller 22 and the support roller 23, and travels in the direction indicated by an arrow shown in FIG. 2.

The auxiliary fixing roller 22 is a roller member that includes a core 22*a* formed of, for example, SUS304, and coated with an elastic layer 22*b* formed of a foamable material, such as foamable silicone rubber. The auxiliary fixing roller 22 contacts the pressure roller 31 serving as a pressure member via the fixing belt 21, thereby forming a nip portion therebetween. By using a foamable material for the elastic layer 22*b*, a width (amount) of the nip portion is relatively large and heat transfer from the fixing belt 21 to the auxiliary fixing roller 22 is reduced. The auxiliary fixing roller 22 rotates clockwise in FIG. 2.

The support roller 23 is a hollow roller member (cylindrical body) formed of a metal such as aluminum or stainless-steel.

The dielectric heating portion includes at least one pair of rod electrodes 25. In the first embodiment, two pairs of rode electrodes 25 are provided as illustrated in FIGS. 2 and 3. Each rod electrode 25 is held at both ends by holders 26, faces the outer surface of the fixing belt 21 including the heat generation layer serving as a dielectric body, and extends across the width of the fixing belt 21. Each rod electrode 25 has a polarity different from that of adjacent rod electrodes 25. A high-frequency electricity with a frequency of 1 to 200 MHz is applied to the rod electrodes 25 from a power source, not shown. Consequently, a high-frequency electric field is generated around the fixing belt 21, the electric lines of force of which are indicated by dashed lines in FIG. 4. The high-frequency electric field causes the heat generation layer (dielectric body) of the fixing belt 21 to be heated by high-frequency dielectric heating, thereby heating the fixing belt 21.

It is preferable that the rod electrodes 25 be located as close as possible to the fixing belt 21 to improve the efficiency of heating of the fixing belt 21 by the dielectric heating portion.

The output of the dielectric heating portion is controlled based on belt surface temperature detection carried out by the temperature sensor 40, such as a thermopile, facing the surface of the fixing belt 21 in a noncontact manner. Specifically, a high-frequency electricity is applied to the rod electrodes 25 for a period of time that is determined based on the temperature detected by the temperature sensor 40. Controlling the output of the dielectric heating portion enables the temperature of the fixing belt 21, i.e., the fixing temperature, to be adjusted to a desired temperature (target control temperature).

The pressure roller 31 serving as a pressure member includes a core 32 and an elastic layer 33 formed on the core 32, with an adhesion layer interposed therebetween. The elastic layer 33 is formed of a material such as foamable silicone rubber, fluororubber, or silicone rubber. A thin releasing layer, formed of, for example, PFA, can be provided on the surface of the elastic layer 33.

The pressure roller 31 presses against the auxiliary fixing roller 22 via the fixing belt 21 by a pressure mechanism, not shown, to form a desirable nip portion therebetween.

It should be noted that in the first embodiment, a heating unit such as a heater may be provided to directly heat the pressure roller 31. Such configuration further improves the temperature rise of the fixing belt 21.

As illustrated in FIG. 2, on an entry side and on an exit side of the nip portion where the fixing belt 21 contacts the pressure roller 31, the guide plates 35 are located to guide the recording medium P. The guide plates 35 are fixedly mounted on a side plate included in the fixing device 20.

Although not illustrated in FIG. 2, a separation plate is located in the vicinity of the exit of the nip portion, facing the outer surface of the fixing belt 21. The separation plate prevents the recording medium P from curling around the fixing belt 21 after the fixing process.

A description is given below of the operation of the fixing device 20 having the above-described configuration.

By turning on a power switch of the image forming apparatus 1, a high-frequency electricity is applied to the dielectric heating portion (rod electrodes 25) from the power source, and the fixing belt 21 (with the auxiliary fixing roller 22 and the support roller 23) and the pressure roller 31 are rotationally driven in the direction indicated by the arrows shown in FIG. 2, respectively.

Subsequently, the recording medium P is fed from the paper feed unit 7 and toner images of each color formed on the photosensitive drums 11Y, 11M, 11C, and 11BK are transferred to the recording medium P as an unfixed image T. The recording medium P carrying the unfixed image T (toner image) is conveyed in a direction indicated by arrow Y10 shown in FIG. 2 to the nip portion formed between the fixing belt 21 and the pressure roller 31, which are pressed against each other. Heat from the fixing belt 21 and pressure from the fixing belt 21 (the auxiliary fixing roller 22) and the pressure roller 31 fix (i.e., melt) the toner image T onto the surface of the recording medium P. Then, the recording medium P is discharged from the nip portion by rotation of the fixing belt 21 and the pressure roller 31 and conveyed in a direction indicated by arrow Y11 shown in FIG. 2.

When the fixing device 20 according to the first embodiment includes the fixing belt 21 formed only of polyamide film and a high-frequency electricity with a frequency of 40 MHz and a voltage of 800 V is applied to the rod electrodes 25, the surface temperature of the fixing belt 21 rises from room temperature to 200° C. in approximately 0.8 seconds and the output image is securely fixed.

Such a start-up time is considerably shorter than that of a conventional fixing device that uses electromagnetic induction heating.

As described above, the fixing device 20 according to the first embodiment includes the dielectric heating portion that heats the fixing belt 21 (fixing member) having the dielectric body (heat generation layer) by dielectric heating. Therefore, an image is securely fixed onto a recording medium and the start-up time of the fixing device is shortened without increasing the device size, cost, and power consumption.

In particular, the first embodiment allows direct heating of the fixing belt 21 (fixing member) formed only of a resin material. Therefore, the fixing device according to the first embodiment is useful in a case in which the use of a metal material in the fixing member is for some reason not possible.

It should be noted that although the pressure roller 31 is used as the pressure member in the first embodiment, alternatively a pressure belt or a pressure pad can be used as the pressure member with the same effect as in the first embodiment.

In addition, the fixing belt 21 serving as a fixing member in the first embodiment has a multilayer structure and includes the dielectric body (heat generation layer), the elastic layer, and the releasing layer. Alternatively, however, the fixing belt 21 can have a single layer structure formed only of a dielectric body (heat generation layer) and still achieve the same effect.

A second embodiment of the present invention is now described with reference to FIGS. 5 and 6.

Figure 5:
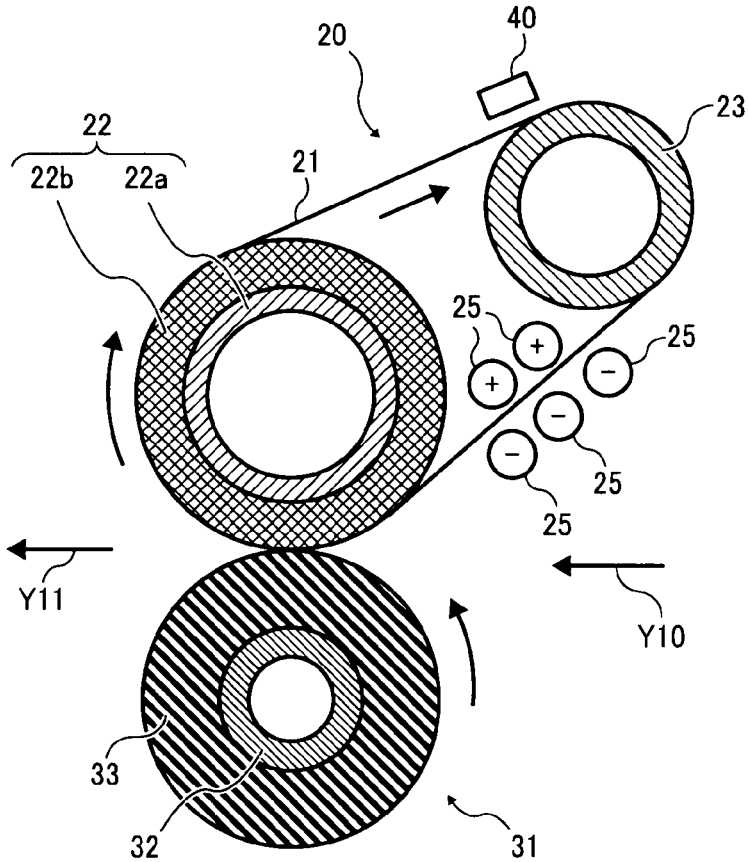
FIG. 5 is a schematic cross-sectional diagram illustrating a fixing device according to a second embodiment of the present invention.

FIG. 5 is a schematic cross-sectional diagram illustrating a fixing device according to the second embodiment of the present invention and corresponds to FIG. 2 illustrating the first embodiment. FIG. 6 is a schematic diagram illustrating electric lines of force generated around the fixing belt 21 included in the fixing device of FIG. 5 and corresponds to FIG. 4 illustrating the first embodiment.

The fixing device according to the second embodiment is the same as in the first embodiment, except that the rod electrodes 25 are located facing both the inner and outer surfaces of the fixing belt 21. By comparison, in the first embodiment, the rod electrodes 25 are located facing only the outer surface of the fixing belt 21.

Similar to the first embodiment, the fixing device 20 according to the second embodiment includes the fixing belt 21 (fixing member), the auxiliary fixing roller 22, the support roller 23, the pressure roller 31 (pressure member), and the dielectric heating portion (rod electrodes 25) as illustrated in FIG. 5.

In the second embodiment, the fixing belt 21 (dielectric body) is located between the rod electrodes 25. Each rod electrode 25 located on the outer side has a polarity different from that of the corresponding rod electrode 25 located on the inner side. A high-frequency electricity with a frequency of 1 to 200 MHz is applied to the rod electrodes 25 from a power source, not shown. Consequently, a high-frequency electric field is generated around the fixing belt 21 (heat generation layer serving as a dielectric body). The electric lines of force are indicated by dashed lines in FIG. 6. The high-frequency electric field causes the heat generation layer (dielectric body) of the fixing belt 21 to be heated by high-frequency dielectric heating, thereby heating the fixing belt 21.

Figure 6:
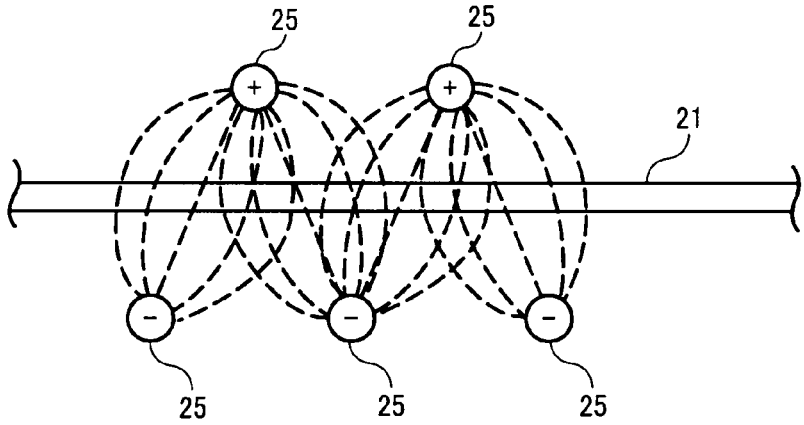
FIG. 6 is a schematic diagram illustrating electric lines of force generated around a fixing belt included in the fixing device of FIG. 5.

Further, in the second embodiment, the fixing belt 21 is located in an area with the highest density of electric lines of force as illustrated in FIG. 6, and therefore the efficiency of heating of the fixing belt 21 by dielectric heating is further improved.

When the fixing device 20 according to the second embodiment includes the fixing belt 21 formed only of polyamide film and a high-frequency electricity with a frequency of 40 MHz and a voltage of 800 V is applied to the rod electrodes 25, the surface temperature of the fixing belt 21 rises from room temperature to 200° C. in approximately 0.6 seconds with a power consumption of 500 W and the output image is securely fixed.

As described above, similar to the first embodiment, the fixing device 20 according to the second embodiment includes the dielectric heating portion that heats the fixing belt 21 (fixing member) having the dielectric body (heat generation layer) by dielectric heating. Therefore, an image is securely fixed onto a recording medium and the start-up time of the fixing device is shortened without increasing the device size, cost, and power consumption.

A third embodiment of the present invention is now described with reference to FIG. 7.

Figure 7:
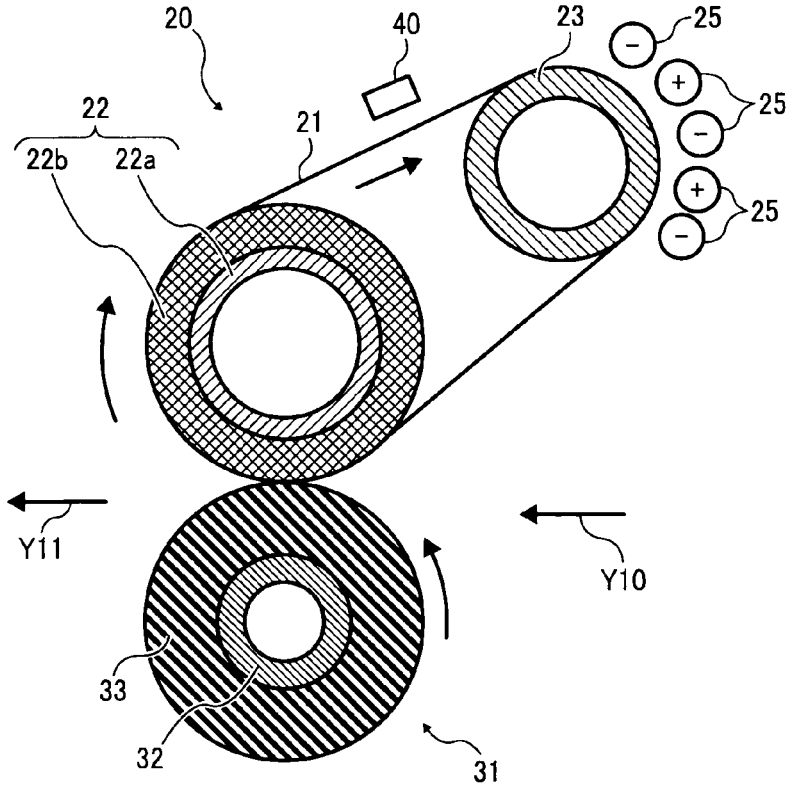
FIG. 7 is a schematic cross-sectional diagram illustrating a fixing device according to a third embodiment of the present invention.

FIG. 7 is a schematic cross-sectional diagram illustrating a fixing device according to the third embodiment of the present invention and corresponds to FIG. 2 illustrating the first embodiment. The fixing device according to the third embodiment is the same as in the first embodiment, except that the dielectric heating portion is located facing the support roller 23 via the fixing belt 21 instead of an area intermediate between the auxiliary fixing roller 22 and the support roller 23.

Similar to the first embodiment, the fixing device 20 according to the third embodiment includes the fixing belt 21 (fixing member), the auxiliary fixing roller 22, the support roller 23, the pressure roller 31 (pressure member), and the dielectric heating portion (rod electrodes 25) as illustrated in FIG. 7.

In the third embodiment, the rod electrodes 25 (dielectric heating portion) are disposed opposite one roller member of the plurality of roller members that stretch the fixing belt 21 via the fixing belt 21. Specifically, the rod electrodes 25 (dielectric heating portion) are located facing the support roller 23 via the fixing belt 21. Each rod electrode 25 has a polarity different from that of an adjacent rod electrode 25. A high-frequency electricity with a frequency of 1 to 200 MHz is applied to the rod electrodes 25 from a power source, not shown. Consequently, a high-frequency electric field is generated around the fixing belt 21 (heat generation layer serving as a dielectric body). The high-frequency electric field causes the heat generation layer (dielectric body) of the fixing belt 21 to be heated by high-frequency dielectric heating, thereby heating the fixing belt 21.

As described above, in the third embodiment, the rod electrodes 25 (dielectric heating portion) are located facing the support roller 23 via the fixing belt 21, thereby reducing the effect of possible fluctuation in the distance between the rod electrodes 25 and the fixing belt 21 as the fixing belt 21 moves. Consequently, uneven heating of the fixing belt 21 by the dielectric heating portion is reduced and uneven fixation of the output image is prevented.

In the third embodiment, it is preferable that the support roller 23 facing the rod electrodes 25 be formed of a material with a low dielectric loss in a high-frequency band to reduce losses by dielectric heating, i.e., to focus heat generated by dielectric heating on the fixing belt 21. Specifically, a surface layer formed of a resin material with a low dielectric loss such as polypropylene, polyethylene, or polytetrafluoroethylene can be provided on the outer surface of the support roller 23.

As described above, similar to the above-described embodiments, the fixing device 20 according to the third embodiment includes the dielectric heating portion that heats the fixing belt 21 (fixing member) having the dielectric body (heat generation layer) by dielectric heating. Therefore, an image is securely fixed onto a recording medium and the start-up time of the fixing device is shortened without increasing the device size, cost, and power consumption.

A fourth embodiment of the present invention is now described with reference to FIG. 8.

Figure 8:
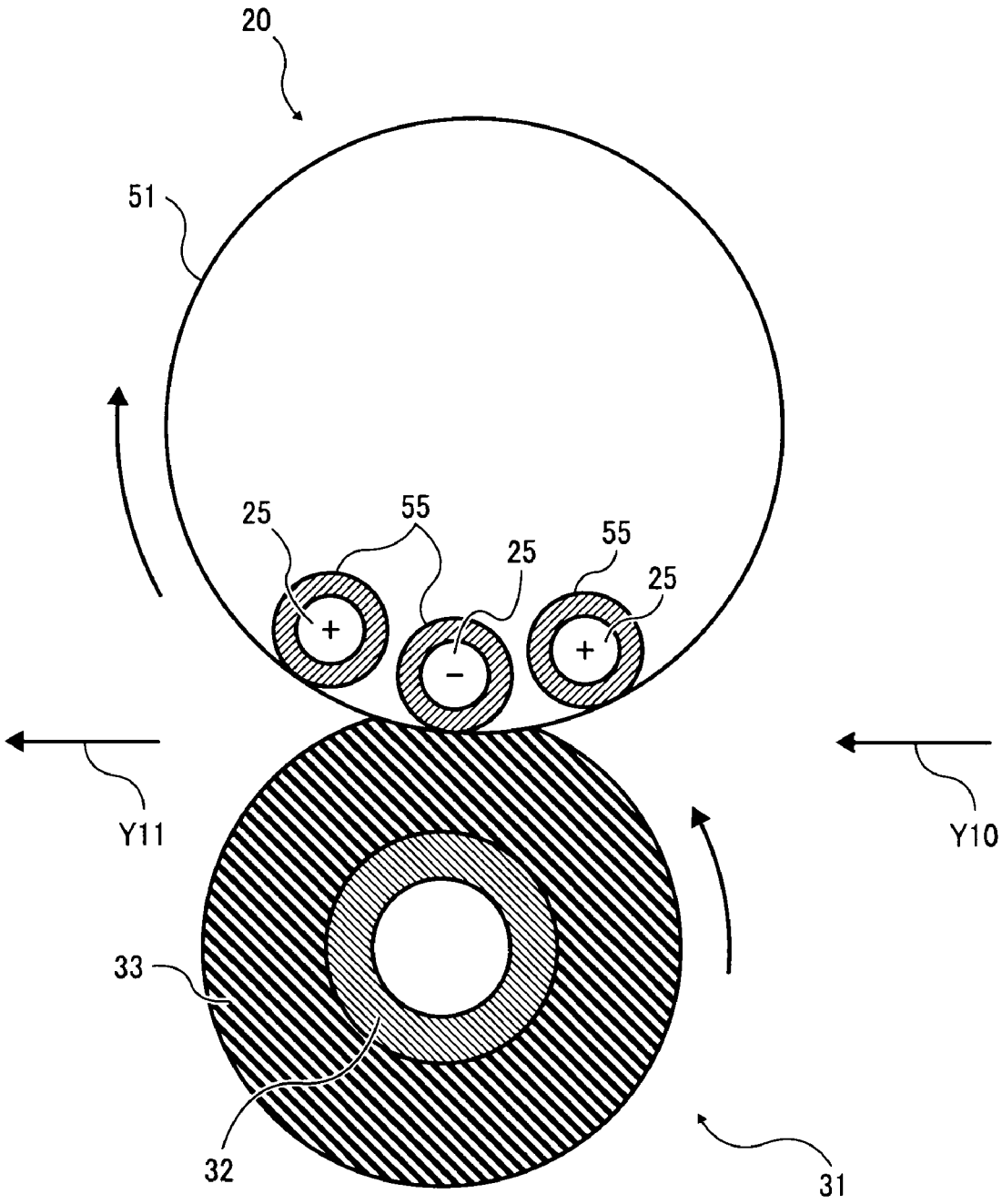
FIG. 8 is a schematic cross-sectional diagram illustrating a fixing device according to a fourth embodiment of the present invention.

FIG. 8 is a schematic cross-sectional diagram illustrating a fixing device according to the fourth embodiment of the present invention. The fixing device according to the fourth embodiment is the same as in the first embodiment, except that a fixing film 51 is used as the fixing member, the rod electrodes 25 are located facing the inner surface of the fixing member, and a rotating member 55 is provided on the outer surface of each rod electrode 25.

The fixing device 20 according to the fourth embodiment includes the fixing film 51 serving as a fixing member, the pressure roller 31 (pressure member), and the dielectric heating portion (rod electrodes 25) as illustrated in FIG. 8.

The fixing film 51 is a thin endless film formed of a dielectric body with a high dielectric loss, such as polyamide.

The rotating member 55 that rotates on the rod electrode 25 is provided on the outer surface of each rod electrode 25 serving as a dielectric heating portion. The rotating member 55 is formed of a resin material with a low dielectric loss, such as polypropylene, polyethylene, or polytetrafluoroethylene, and configured so as not to be heated by the rod electrode 25 by dielectric heating.

The rotating member 55 contacts the inner surface of the fixing film 51 at the nip portion to function as a spacer. Specifically, the distance between the rod electrodes 25 and the inner surface of the fixing film 51 is kept constant when the pressure is exerted on the fixing film 51 by the pressure roller 31. Consequently, uneven heating of the fixing film 51 by the dielectric heating portion is reduced and uneven fixation of the output image is prevented.

In addition, the rotating member 55, which is rotatable on the rod electrode 25, rotates according to movement of the fixing film 51 in the direction indicated by an arrow shown in FIG. 8, thereby reducing wear on or degradation of the inner surface of the fixing film 51.

A description is given below of the operation of the fixing device 20 having the above-described configuration.

By turning on the power switch of the image forming apparatus 1, a high-frequency electricity is applied to the dielectric heating portion (rod electrodes 25) from the power source, and the fixing film 51 and the pressure roller 31 are rotationally driven in the direction indicated by the arrows shown in FIG. 8, respectively.

Subsequently, the recording medium P is fed from the paper feed unit 7 and toner images of each color formed on the photosensitive drums 11Y, 11M, 11C, and 11BK are transferred to the recording medium P as an unfixed image T. The recording medium P carrying the unfixed image T (toner image) is conveyed in the direction indicated by arrow Y10 shown in FIG. 8 to the nip portion formed between the fixing film 51 and the pressure roller 31, which are pressed against each other. By application of heat from the fixing film 51 and pressure from the fixing film 51 and the pressure roller 31, the toner image T is fixed onto the surface of the recording medium P. Then, the recording medium P is discharged from the nip portion by rotation of the fixing film 51 and the pressure roller 31 and conveyed in the direction indicated by arrow Y11 shown in FIG. 8.

As described above, the fixing device 20 according to the fourth embodiment includes the dielectric heating portion that heats the fixing film 51, which is formed only of a dielectric body and serves as a fixing member having a dielectric body, by dielectric heating. Therefore, an image is securely fixed onto a recording medium and the start-up time of the fixing device is shortened without increasing the device size, cost, and power consumption.

It should be noted that although the fixing film 51 is used as the fixing member in the fourth embodiment, alternatively a fixing roller can be used as the fixing member.

In addition, it should be noted that the present invention is not limited to each of the above-described embodiments, and therefore the number, position, and shape of the above-described components are not limited to those described in each of the embodiments and can be changed in a way to adequately achieve the present invention.

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program or computer program product. For example, the aforementioned methods may be embodied in the form of a system or device, including, but not limited to, any of the structures for performing the methodology illustrated in the drawings.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. A fixing device comprising:

a plurality of rod electrodes to generate an electric field;

a plurality of rotatable members rotatable on an outer surface of each of the plurality of rod electrodes;

a fixing film comprising a dielectric material surrounding each of the plurality of rotatable members which is heated by the electric field from the rod electrodes; and a pressure roller disposed opposite to the plurality of rotatable members to form a nip between the fixing film and the pressure roller at which a recording medium having toner thereon is fixed using heat and pressure.

2. The fixing device according to claim 1, further comprising:

a power source which applies electricity with a frequency of 1 to 200 MHz to the plurality of rod electrodes.

3. The fixing device according to claim 1, wherein the dielectric material comprises polyamide.

4. An image forming apparatus comprising a fixing device, the fixing device comprising:

a plurality of rod electrodes to generate an electric field;

a plurality of rotatable members rotatable on an outer surface of each of the plurality of rod electrodes;

a fixing film comprising a dielectric material surrounding each of the plurality of rotatable members which is heated by the electric field from the rod electrodes; and a pressure roller disposed opposite to the plurality of rotatable members to form a nip between the fixing film and the pressure roller at which a recording medium having toner thereon is fixed using heat and pressure.

5. The image forming apparatus according to claim 4, further comprising:

a power source which applies electricity with a frequency of 1 to 200 MHz to the plurality of rod electrodes.

6. The image forming apparatus according to claim 4, wherein the dielectric material comprises polyamide.

* * * * *